United States Patent [19]

Allred

[11] 4,243,511

[45] Jan. 6, 1981

[54] PROCESS FOR SUPPRESSING CARBONATE DECOMPOSITION IN VAPOR PHASE WATER RETORTING

[75] Inventor: Victor D. Allred, Littleton, Colo.

[73] Assignee: Marathon Oil Company, Findlay, Ohio

[21] Appl. No.: 23,852

[22] Filed: Mar. 26, 1979

[51] Int. Cl.[3] ..... C10G 1/02

[52] U.S. Cl. ..... 208/11 R; 202/106

[58] Field of Search ..... 208/11 R

[56] References Cited

U.S. PATENT DOCUMENTS

| | | | |
|---|---|---|---|
| 3,480,082 | 11/1969 | Gilliland | 208/11 R |
| 3,960,702 | 6/1976 | Allred | 208/11 R |

*Primary Examiner*—Herbert Levine

*Attorney, Agent, or Firm*—Jack L. Hummel

[57] ABSTRACT

Oil shale containing relatively large quantities of alkaline carbonate minerals is retorted utilizing superheated water vapor at temperatures of from about 425° C. to about 510° C. Retorting with a sufficient carbon dioxide partial pressure effectively suppresses decomposition of the alkaline carbonates to obtain an environmentally acceptable retorted shale.

7 Claims, 2 Drawing Figures

SHALE BIN
TO STACK
LOCK HOPPER
10
55
COMBUSTION AIR
COMPRESSOR
SHALE PREHEATER
44
46
GAS PRODUCT
45
RECUPER-ATOR
26
7
42
RETORT
COMPRES-SOR
SUPERHEATER
EVAPORATOR CONDENSER
OIL,GAS,WATER SEPARATOR
OIL PRODUCT
57
13
MAKEUP WATER
ROLL CRUSH-ER
FUEL
SLURRY TANK
RECYCLE WATER
RETORTED SHALE SLURRY
61
51
$CO_2$ SPRINGER
$CO_2$ ABSORBER
$CO_2$ RECYCLE
52
54
50
53
GAS OUT

PROCESS FOR SUPPRESSING CARBONATE DECOMPOSITION IN VAPOR PHASE WATER RETORTING

DESCRIPTION

1. Technical Field

This invention relates to a process for retorting oil shale utilizing superheated water vapor, and more particuarly, to a process for retorting oil shale utilizing superheated water vapor wherein a carbon dioxide-containing gas is introduced into the retort to provide a carbon dioxide partial pressure sufficient to effectively suppress decomposition of inorganic carbonate minerals contained in the oil shale.

2. Background Art

Retorting oil shale to yield shale oil and gases has been practiced for over 100 years. A myriad of processes have been proposed in the prior art for improving the efficiency and lowering the operating costs of retorting oil shale, as well as for rendering retorting processes and the products thereof environmentally acceptable. One such proposed process involves the use of superheated water vapor as a retorting agent.

In light of current environmental regulations, producing a retorted shale which is environmentally acceptable for disposal is of major concern in operating all of these prior art processes. Retorted shale must be environmentally compatible with the soil upon which it is deposited and must be capable of being revegetated within a relatively short period of time. A problem which has plagued prior art processes is decomposition of alkaline carbonate minerals, which are present in relatively large amounts in oil shales from the Green River Formation of Colorado, Utah and Wyoming. The alkaline carbonate minerals, such as calcium carbonate and magnesium carbonate, will thermally decompose to the corresponding oxides. Therefore, retorting an oil shale containing substantial amounts of alkaline carbonate minerals will yield a retorted shale having a relatively high alkaline metal oxide content. This highly alkaline retorted shale is environmentally unacceptable since natual precipitation produces a high pH leach unacceptable for discharge to the surrounding environment, and since revegetation thereof is extremely difficult. In addition, U.S. Pat. No. 2,899,365, to Scott discloses that carbonate decomposition consumes heat in amounts which are intolerable to the retorting processes involved.

To minimize the carbonate decomposition problem, several prior art processes have suggested retorting oil shale containing carbonate minerals at a relatively low temperature and a relatively high carbon dioxide partial pressure. U.S. Pat. No. 2,705,697 to Royster, U.S. Pat. No. 3,480,082 to Gilliland and U.S. Pat. No. 4,016,239 to Fenton, disclose that alkaline metal carbonates begin to decompose at temperatures of about 538° C. and such calcining creates a serious problem at retorting temperatures above about 538° C. U.S. Pat. No. 3,480,082 utilizes a carbon dioxide partial pressure of at least 3447 kPa (kiloPascal) g. to prevent calcining of the carbonates. U.S. Pat. No. 3,074,877 to Friedman discloses largely preventing decomposition of carbonates by retorting oil shale with a carbon dioxide-containing gas at temperatures of about 371° C. to about 482° C. and at carbon dioxide partial pressures of about 6,894 to 20,684 kPag. Further, U.S. Pat. No. 3,058,904 to Deering et al discloses that the product gas recycled to an oil shale retort (utilized as an eduction gas) has a carbon dioxide partial pressure sufficient to retard mineral carbonate decomposition. Campbell teaches in "The Kinetics of Decomposition of Colorado Oil Shale: II Carbonate Minerals", UCRL—S2089 Part 2, Mar. 13, 1978, that steam retorting reduces the temperature of carbonate decomposition but accelerates the calcite ($S:O_2$) and other solid-state reactions. The benefits of steam depend on both the partial size and the rate of diffusion of steam into the shale.

The present invention relates to a discovery that in retorting oil shale utilizing superheated water vapor at temperatures of from about 425° C. to about 510° C. substantial decomposition of alkaline carbonate minerals contained in the oil shale occurs. Thus, a need exists for a vapor phase water retorting process wherein alkaline metal carbonate decomposition is effectively suppressed so as to obtain an environmentally acceptable retorted shale.

DISCLOSURE OF INVENTION

The present invention provides a process for retorting oil shale containing relatively large quantities of alkaline carbonate minerals, such as magnesium carbonate and calcium carbonate, wherein carbonate decomposition is effectively retarded. The oil shale is retorted utilizing superheated water vapor at temperatures of from about 425° C. to about 510° C. at a pressure of from about 6.9 to about 1,034 kPaa and at a superficial gas velocity of from about 10 to about 500 cm per second.

A sufficient carbon dioxide partial pressure is provided to effectively suppress carbonate decomposition during retorting. This carbon dioxide partial pressure may be provided by recycling to the retort carbon dioxide selectively absorbed from the retort product gases or by introducing an oxygen-containing gas into the retort at a location such that oxygen reacts with residual carbonaceous matter present in the retorted shale to form carbon dioxide.

BEST MODE FOR CARRYING OUT THE INVENTION

The present invention relates to an improvement in a process for treatment of oil shale with superheated water vapor as described in applicant's U.S. Pat. No. 3,960,702 issued June 1, 1976, which is incorporated herein by reference. This process utilizes a critical interrelationship between the pressure at which contact between oil shale and superheated water vapor occurs and the superficial gas velocity so as to maximize the recovery of organic values from the oil shale.

Figure 1:
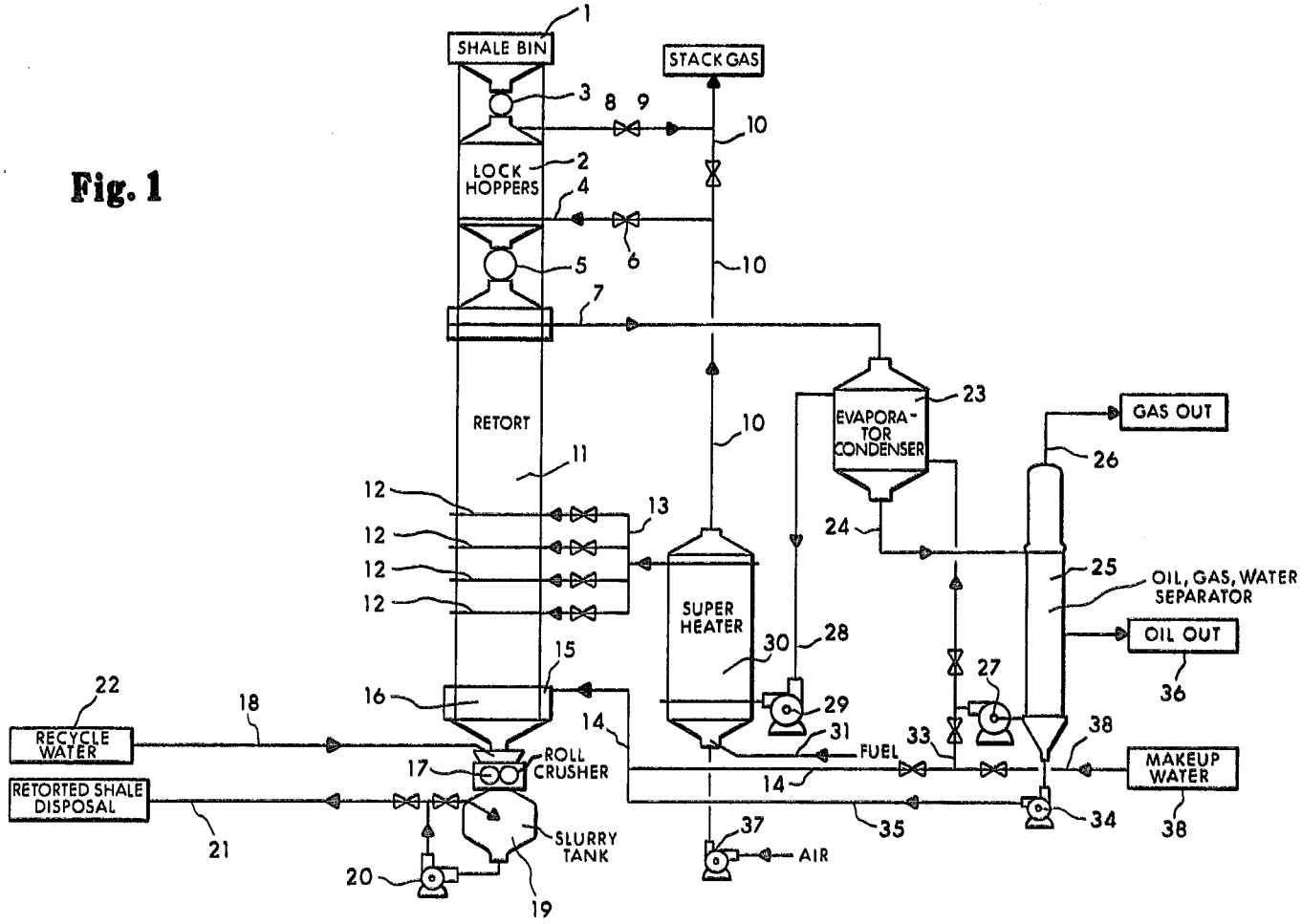
FIG. 1 is a schematic flow diagram of a process for retorting oil shale utilizing superheated water vapor.

Referring now to FIG. 1, the process disclosed in U.S. Pat. No. 3,960,702 is schematically illustrated. Crushed and sized oil shale is stored in a surge bin 1 and enters lock hopper 2 through valve 3. The oil shale is pressurized and heated in lock hopper 2 to about 241–483 kPag and about 149° C. by hot stack gas via line 4. Upon charging hopper 2 with shale, valve 3 is closed and valve 6 opened to pressurize the hopper. Off-gas from the hopper exists via line 8 and is permitted by back pressure regulator 9 to pass to stack gas breeching 10 once the hopper has reached the desired pressure. Upon obtaining the desired temperature and pressure, valve 5 is opened allowing shale to pass into retort 11. Superheated water vapor is injected into the retort 11 through the gas distributors 12 from the manifold 13. The upwardly moving superheated water vapor countercurrently contacts the oil shale which is passing downwardly by gravity in retort 11. The superheated water vapor heats the oil shale to a temperature sufficient to pyrolize the organic values of the oil shale thereby producing shale oil, gases and carbon. The remaining retorted shale will generally have a residue of carbonaceous matter thereon. The retort temperature will preferably be in the range of from about 425° C. to about 510° C., more preferably from about 450° C. to about 485° C. and most preferably from about 450° C. to about 470° C. The retort pressure utilized during contact between the oil shale and the superheated water vapor will preferably be in the range of from about 6.9 to about 1,034 kPaa, more preferably from about 13.8 to about 689 kPaa and most preferably from about 241 to about 517 kPaa. The superficial gas velocity will preferably be in the range of from about 10 to about 508 cm per second, more preferably from about 10 to about 305 cm per second, and most preferably from about 25 to about 203 cm per second. By maintaining these parameters within the aforedescribed ranges, maximum efficiency in the recovery of hydrocarbons from oil shale is achieved.

The retorted shale is cooled to near the condensation temperature of water by injecting water via line 14 through a distributor 15 onto the retorted shale thereby defining a quench zone within retort 11. As the water contacts the hot shale steam is formed which passes upwardly through the retort cooling the retorted shale while concurrently being preheated to pyrolysis temperatures.

From discharge mechanism 16, retorted shale is crushed by roll crusher 17 in the presence of water from line 18 to a sufficiently small size so as to be readily transported as a slurry. Pump 20 agitates the slurry which is prepared in tank 19 to maintain the shale suspended therein, and further, transports the slurry to the disposal site via line 21. Water 22 is reclaimed from the disposal site and recycled back to crusher 17 via line 18.

Retort off-gas exits retort 11 via line 7. This off-gas consists of water and shale oil vapors, light hydrocarbon gases, hydrogen and carbon oxides. Shale oil vapors and water vapor are condensed in heat exchanger 23, transported with non-condensible product gases through line 24 to an oil, gas, and water separator 25, and separated from the non-condensible product gases in separator 25. Water vapor from heat exchanger 23 passes via line 28 to compressor 29 where the pressure thereof is increased to near that of the retort. The pressurized water vapor then passes through a superheater 30 where the temperature thereof is raised to about 538° C. prior to entering the retort via line 13. Superheater 30 is fired by either process oil or gas transported via line 31. Compressor 37 supplies combustion air under pressure to superheater 30.

Water is removed from separator 25 at two locations. The bulk is removed by pump 27 and transported to the shell side of heat exchanger 23. A portion of this water may be drawn off through line 33 and utilized as make up water for the process which is supplied as required via line 38. Water is also removed from the bottom of separator 25 and is transported by pump 34 through line 35 and line 14 to quench shale in retort 11. Shale oil, which is lighter than and essentially immiscible with water, is removed from separator 25 through line 36 for processing. Alternative embodiments of this process are as described in U.S. Pat. No. 3,960,702.

Although the retorting process just described can be applied to any of the naturally occurring kerogen-containing deposits, it is particularly preferred to utilize oil shales, such as Colorado oil shale, which contain large amounts of alkaline carbonate minerals, i.e., minerals containing magnesium carbonate and/or calcium carbonate. Such alkaline carbonates are known to decompose in the presence of heat to corresponding oxides thereby yielding a retorted shale having a high alkaline metal oxide content. This high alkaline metal oxide content retorted shale is environmentally unacceptable for disposal as such shale does not readily lend itself to revegetation at disposal sites and yields a high pH leach when subjected to precipitation. Carbonate decomposition is also undesirable due to the amount of heat consumed by such decomposition, and therefore, unavailable for retorting.

Previously, such alkaline carbonate mineral decomposition was believed to occur at an extremely slow rate at temperatures below 538° C. Thus, by operating a retorting temperature below 538° C., the problems created by alkaline carbonate mineral decomposition were believed to be substantially obviated. it has now been discovered that when retorting oil shales with superheated water vapor at temperatures from about 425° C. to about 510° C., the water vapor significantly accelerates the decomposition of alkaline carbonate minerals. Although not completely understood, it is believed that water vapor reacts with alkaline carbonates, for example magnesium carbonate, in accordance with the following reaction:

$$MgCO_{3(s)} + H_2O_{(g)} \xrightarrow[482^\circ\ C.]{\Delta} Mg(OH)_{2(s)} + CO_{2(g)}$$

$$(\Delta \quad \downarrow\uparrow \quad 482^\circ\ C.)$$

$$MgO_{(s)} + H_2O_{(g)}$$

Since water vapor is an end product of this reaction, the reaction is partially self-sustaining. Thus, in accordance with the present invention, carbon dioxide is either recycled to or generated in the retort so as to create a carbon dioxide partial pressure within the retort sufficient to effectively suppress carbonate decomposition caused by water vapor at retorting temperatures of about 425° C. to about 510° C. Thus, an environmentally acceptable retorted shale is obtained by the process of the present invention, while heat loss attributable to carbon decomposition is minimized.

Figure 2:
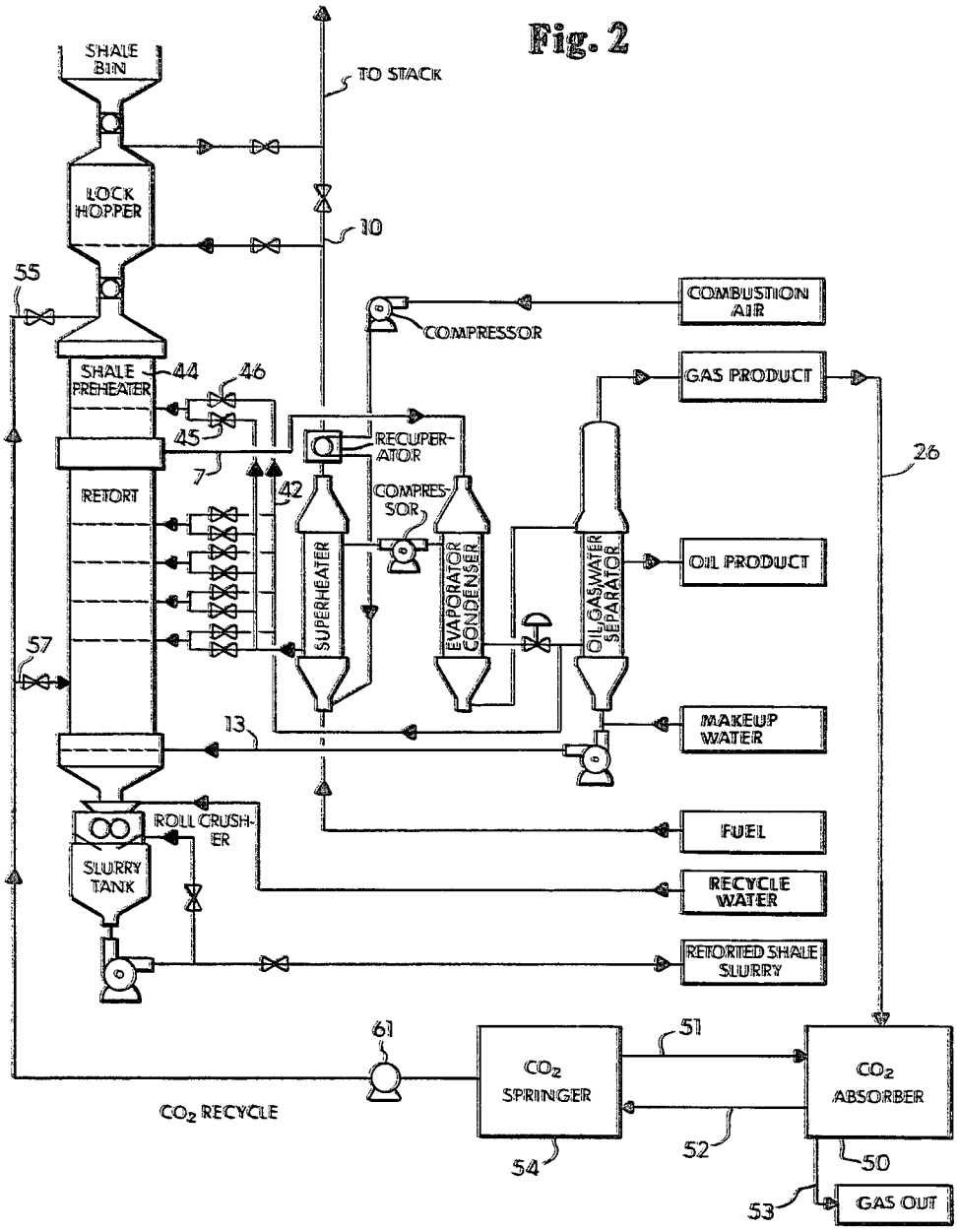
FIG. 2 is a schematic flow diagram of one embodiment of the process of the present invention for recycling carbon dioxide to a retort.

Referring now to FIG. 2, one embodiment of the process of the present invention is illustrated. The basic retorting process shown in FIG. 2 is substantially identical to the aforedescribed retorting process of FIG. 1 except that a shale preheater 44 is positioned between the lock hopper and the retort. Superheated water vapor is introduced into the preheater 44 via line 13 and control value 46 to heat the incoming shale to the temperature of condensing water at the retort operating pressure. The resultant partially condensed vapors exit with retort gases via line 7 to the recovery section of the process. If required, water can be added through value 45 and line 42 to control the steam temperature.

In accordance with the present invention, the non-condensible gases separated from oil and water in separator 25 are transported via line 26 to a carbon dioxide absorber 50 which may be any suitable, conventional absorber. The product gases will normally contain a substantial volumetric proportion of carbon dioxide, for example about 25 to about 40 vol %. A suitable selective absorption medium, such as a diethyanol amine, is introduced into absorber 50, contacts the non-condensible product gases, and selectively absorbs carbon dioxide therefrom. The remaining non-condensible product gases exit absorber 50 via line 53 to conventional treatment units. The carbon dioxide rich absorption medium is transported from absorber 50 via line 52 to carbon dioxide springer 54. Springer 54 may be any conventional springer such as, for example, a unit wherein the solution is heated to a temperature sufficient to reduce the solubility of carbon dioxide in the absorption medium so as to evolve substantially all of the carbon dioxide therefrom. The resultant carbon dioxide lean absorption medium is recycled via line 51 to absorber 50.

The evolved carbon dioxide-containing gas, which is substantially carbon dioxide, is transported via line 55. A substantial proportion of the carbon dioxide-containing gas is drawn off line 55 via line 57 and introduced into the retort 11 just above the water quenching zone in the lower end thereof. Compressor 61 may be utilized to impart sufficient pressure to the carbon dioxide-containing gas for entry into retort 11 via lines 55 and 57. Introducing the carbon dioxide-containing gas at the upper end of the shale preheater 44 and near the lower end of retort 11, not only provides for relatively uniform distribution of the gas throughout the retort and preheater, but also functions as a seal gas for the preheater and retort, i.e., minimizes leakage of retort product gas through the upper valve connecting the preheater and lock hopper and through the lower end of retort 11. The carbon dioxide exerts a partial pressure sufficient to effectively suppress decomposition of the alkaline carbonates contained in the oil shale. As only a small amount of carbonate decomposition occurs when carbon dioxide is recycled to the retort pursuant to the present invention, additional heat which would have been consumed in the carbonate decomposition reaction is available for retorting oil shale.

EXAMPLE

Two identical cylindrical core samples of oil shale from the Green River Formation having a high calcite and dolomite content and having their vertical axis normal to shale bedding planes were heated in an $H_2O$ atmosphere (a) and in a $H_2O/CO_2$ atmosphere (b) to devolatilize them. Thereafter, the residual carbon on the retorted oil shales was oxidized by introducing air into the gas streams. The core samples were initially weighed and then weighed continuously during devolatilization and oxidation by a recording thermo balance at a temperature of about 482° C. The results of these tests are reported in Table 1.

TABLE 1

| | A | B |
|---|---|---|
| Sample weight | 28.7066 g. | 29.5932 g. |

TABLE 1-continued

| | A | B |
|---|---|---|
| Weight loss during devolatilization | 2.7120 g. | 2.4960 g. |
| Weight loss percentage (based on total weight of sample) | 9.45% | 8.43% |
| Weight loss during oxidation | 1.5340 g. | 0.4760 g. |
| Oxidative weight loss percentage (based on total weight of sample | 5.34% | 1.61% |
| % Total weight loss | 14.79% | 10.04% |
| Relative percent carbonate decomposition | 4.75% | 0* |

*Reference level

The relative difference in weight loss encountered in these tests is the direct result of alkaline carbonate decomposition. Thus, it is apparent from a comparison of Tests A and B that conducting Test B in an atmosphere having a carbon dioxide partial pressure has effectively suppressed the low temperature carbonate decomposition.

Thus, the present invention provides a process for effectively suppressing alkaline metal carbonate decomposition during the retorting of oil shale utilizing a superheated water vapor at temperatures of from about 425° C. to about 510° C. The process of the present invention provides an economical solution to carbonate decomposition in that a readily available portion of the retort product gas can be recycled to create a sufficient carbon dioxide partial pressure thereby minimizing the costs of procuring the requisite carbon dioxide.

While the foregoing preferred embodiment of the invention has been described and shown, it is understood that all alterations and modifications, such as those suggested, and other may be made thereto, and fall within the scope of the invention.

I claim:

1. In a process for the recovery of organic values from oil shale containing alkaline metal carbonates by contacting said oil shale with superheated water vapor in a retort wherein the recovery of said hydrocarbon values is enhanced by contacting particles of said oil shale with said superheated water vapor at a superficial gas velocity of at least 10 cm per second and at a pressure in the range of from about 6.9 to about 1,034 kPaa and by providing said contact with said superheated water vapor at a temperature of from about 425° C. to about 510° C. to produce an effluent stream comprising superheated water vapor, hydrocarbon vapors, hydrogen, and carbon oxides, the improvement comprising:

providing a carbon dioxide partial pressure during said contacting which is sufficient to effectively suppress thermal decomposition of said carbonates to oxides.

2. The process of claim 1 wherein said carbon dioxide partial pressure is provided by separating carbon dioxide from said effluent stream and introducing said separated carbon dioxide into said retort.

3. The process of claim 2 wherein said separated carbon dioxide is introduced into said retort at locations adjacent to the top and the bottom of said retort so as to minimize leakage to retort product gases from the retort and to uniformly distribute said carbon dioxide throughout said retort.

4. The process of claim 1 wherein the superheated water vapor is about 450° C. to about 480° C.

5. The process of claim 1 wherein the superheated water vapor is about 450° C. to about 470° C.

6. The process of claim 1 wherein the pressure is about 13.8 to about 689 kPaa.

7. The process of claim 1 wherein the superficial gas velocity is about 10 to about 305 cm per second.

* * * * *

UNITED STATES PATENT AND TRADEMARK OFFICE

CERTIFICATE OF CORRECTION

PATENT NO. : 4,243,511

DATED : January 6, 1981

INVENTOR(S) : Victor D. Allred

It is certified that error appears in the above-identified patent and that said Letters Patent are hereby corrected as shown below:

| | |
|---|---|
| Col. 1, line 43: | Delete "natual" and insert --natural--. |
| Col. 2, line 9: | Delete "partial" and insert -- particle--. |
| Col. 3, line 1: | Delete "exists" and insert --exits--. |
| Col. 4, line 30: | Delete "it" and insert --It--. |
| Col. 4, line 66: | Delete "value" and insert --valve--. |
| Col. 5, line 2: | Delete "value" and insert --valve--. |
| Col. 6, line 57: | Delete "to" and insert --of--. |

Signed and Sealed this

*Twenty-fifth* Day of *August 1981*

[SEAL]

*Attest:*

GERALD J. MOSSINGHOFF

*Attesting Officer*

*Commissioner of Patents and Trademarks*